US009114863B2

(12) United States Patent
White, I

(10) Patent No.: US 9,114,863 B2
(45) Date of Patent: Aug. 25, 2015

(54) AERODYNAMIC FAIRING AND FLAP FOR GENERATING LIFT AND METHODS OF USING THE SAME

(71) Applicant: Christopher Robert White, I, South Dartmouth, MA (US)

(72) Inventor: Christopher Robert White, I, South Dartmouth, MA (US)

( * ) Notice: Subject to any disclaimer, the term of this patent is extended or adjusted under 35 U.S.C. 154(b) by 0 days.

(21) Appl. No.: 14/142,370

(22) Filed: Dec. 27, 2013

(65) Prior Publication Data

US 2014/0182500 A1 Jul. 3, 2014

Related U.S. Application Data

(60) Provisional application No. 61/848,234, filed on Dec. 28, 2012.

(51) Int. Cl.

| | |
|---|---|
| ***B63B 35/00*** | (2006.01) |
| ***B63H 9/04*** | (2006.01) |
| ***B63B 15/00*** | (2006.01) |
| *B63H 9/06* | (2006.01) |

(52) U.S. Cl.

CPC ..... *B63H 9/04* (2013.01); *B63B 15/0083* (2013.01); *B63H 2009/0635* (2013.01)

(58) Field of Classification Search

CPC ..... B63B 15/02; B63B 15/083; B63B 35/00; B63H 9/04; B63H 2009/0635

USPC ..... 114/39.29, 39.31, 102.29, 102.32, 114/102.33

See application file for complete search history.

(56) References Cited

U.S. PATENT DOCUMENTS

| | | | | |
|---|---|---|---|---|
| 4,402,277 | A * | 9/1983 | Wainwright | 114/102.22 |
| 4,685,410 | A * | 8/1987 | Fuller | 114/39.31 |
| 4,982,679 | A * | 1/1991 | Walker | 114/102.16 |
| 5,263,429 | A * | 11/1993 | Brinkmann | 114/105 |
| 7,461,609 | B1 * | 12/2008 | Ott et al. | 114/102.29 |
| 8,919,272 | B2 * | 12/2014 | White | 114/39.31 |

* cited by examiner

*Primary Examiner* — Daniel V Venne

(74) *Attorney, Agent, or Firm* — Lathrop & Gage LLP

(57) ABSTRACT

Embodiments of the present invention are directed to devices and methods for powering a craft by aerodynamic forces. The device features a fairing member and flap element in which the flap element has a first flap position which creates a aerofoil contour on one face of the fairing member, and a second position in which the flap element presents an interrupted surface on both sides of the aerofoil to direct the fairing member in a non-power position without oscillation.

22 Claims, 3 Drawing Sheets

AERODYNAMIC FAIRING AND FLAP FOR GENERATING LIFT AND METHODS OF USING THE SAME

CROSS-REFERENCE TO RELATED APPLICATIONS

This application claims priority to a provisional application Ser. No. 61/848,234 filed Dec. 28, 2012, entitled Novel Flap Configuration for Rigid Sail, the entire contents of which is incorporated by reference.

STATEMENT REGARDING FEDERAL FUNDING AND SPONSORSHIP

Embodiments of the present invention were conceived and developed without Federal funding or sponsorship.

FIELD OF INVENTION

The present invention relates to aerodynamic lift devices for watercraft, ice craft and land craft which are powered wind.

BACKGROUND OF THE INVENTION

Unless the context of the text requires otherwise, the term "craft" means any vehicle, watercraft, or ice craft. Examples of a vehicle would include wheeled vehicles and the like. Watercraft comprise by way of example, without limitation single, multihull and hydrofoil vessels. As used herein, ice craft comprises vehicles having skis and/or skate like blades for traveling over ice or snow surfaces.

As used herein, the term "mast" will mean a rigid structural member projecting in a generally vertical direction from a deck or base to which it is attached. A "stay" is a rigid or flexible structural member providing lateral support to a mast to which it is attached. A stay is generally attached to a mast at a point away from the mast's point of attachment at a deck or base, that is, up the mast, and secured to the deck or mast away from, or distal to the attachment of the mast to the deck or base.

As used herein, the term "sail" means a flexible sheet in the nature of fabric, membrane, or sheet used to capture wind or provide an aerodynamic lift. The term "lift" is not intended to denote an upward force, but rather refers to a component of the force that is perpendicular to the oncoming flow direction of air movement over a surface.

It is desirable to have rigid aerodynamic lift surfaces that can be carried or mounted to a mast and controlled through all wind directions. That is, the aerodynamic lift surfaces can assume a power position generating lift or a non-power position in which the aerodynamic lift surfaces do not generate substantial lift.

SUMMARY OF THE INVENTION

Embodiments of the present invention are directed to devices and methods of using such devices which have rigid aerodynamic lift surfaces that can be carried or mounted to a mast and controlled through all wind directions. The aerodynamic lift surfaces can assume a power position generating lift or a non-power position in which the aerodynamic lift surfaces do not generate substantial lift. Thus, craft carrying the devices of the present invention can maintain the device mounted on or to the mast through a range of wind conditions allowing the rigid aerodynamic lift surfaces to assume a non-power position where it may be advantageous to do so. For example, without limitation, a non-power position is advantageous for crafts at rest, where movement is not desired, for example a parked ice craft, a boat at mooring or at a dock. A non-power position is advantageous water craft in some heavy weather where excessive wind forces can compromise handling or lead to knock downs and roll-overs.

One embodiment of the present invention is directed to a device or apparatus for powering a craft by aerodynamic forces. The device is particularly suited for a craft having a mast member having a base end, a top end and an elongated body. The base end of the mast member is constructed and arranged for attachment to a base of a craft, with the top end projecting away from the craft in an upward direction. The device comprises a fairing member constructed and arranged for rotational attachment to the mast member and substantially encasing the elongated body of the mast member, having a fairing base end and a fairing top end corresponding to the mast member. The fairing has a first fairing surface and a second fairing surface defining a symmetrical aerofoil cross-sectional shape with a projecting rounded forward face, an extending tapered back with a fairing back edge. The device further comprises one or more flap elements, wherein each flap element has a first flap surface and a second flap surface. The first flap surface is associated with the first fairing surface and the second flap surface is associated with the second fairing surface. Each flap surface has a forward edge towards the mast and a back edge distal to the mast and mechanically linked such that at least one of the first flap surface and second flap surface is projecting out from the first fairing surface and second fairing surface. Each flap element is constructed and arranged to assume at least a first position and a second position. In the first position one of the first flap surface and second flap surface is aligned with the associated first fairing surface and the second fairing surface to define an aerofoil contour providing aerodynamic lift and the other flap surface is set at an angle of 60 to 120 degrees with respect to the corresponding fairing surface. And, in the second position, the first flap surface and second flap surface are projecting away from the respective fairing first surface, and second fairing surface substantially equals angle such that no aerodynamic lift is made. The flap element is moveable to assume at least the first or second positions relative to the fairing member to increase aerodynamic lift or to assume a position in which the flap element provides no aerodynamic lift.

As used herein, the term "associated" means constructed and arranged to allow the surfaces to assume a single aerodynamic surface. As used herein, the term "mechanically linked" means, the relative positions are locked in place, fixed by means of braces, or forming a unitary structure in which the flap has a first flap surface and a second flap surface which forms a "V" shape in cross section or form. The "V" shape or form encompasses an angle of about 25 to 100 degrees measured from the interior of the "V" form, the included angle. An angle of about 45 to 55 degrees is preferred for some applications.

One embodiment of the present device features one or more flap elements wherein the first flap surface and second flap surface are joined about the forward edge to form a forward edge angle. The flap element is rotatably mounted to the fairing member at the first flap forward edge and the second flap forward edge. One embodiment of the device features the first flap edge and second flap edge are rotatably mounted to said fairing at the fairing back edge.

One embodiment of the present device features a fairing member that is rotatable about the mast to assume a power position and a non-power position. In the power position the fairing member and the one or more flap elements define at least one aerofoil contour about a first fairing surface and second fairing surface providing aerodynamic lift. And, in the non power position, the fairing has the projected rounded face directed into a wind and the one or more flap elements has the first flap surface and second flap surface projecting away from respective fairing first surface and fairing second surface substantially equal angles such that no aerodynamic lift is made. With the flap element assuming a second position, the fairing member will assume a non-power position unless compelled to do so. Preferably, the fairing member is constructed and arranged to rotate a full 360 degrees with respect to the craft. In heavy weather situations, the second position of the flap element allows the fairing member to weathercock to the wind with the flap element directing such movement and dampening oscillations.

Embodiments of the present device feature control elements for compelling the fairing member to assume a power position and the flap element to assume a first position, or to allow the fairing member to assume a non-power position with the flap elements in the second position wherein the one or more flap elements create substantially equal resistance about the fairing member. Preferably, where the fairing member is allowed to weathercock with respect to the wind, the flap element is set in the second position and the fairing member assumes the non-power position under the influence of the wind.

Embodiments of the present invention are well suited for use on craft in which the mast member has a base end that is constructed and arranged for attachment to a base of a craft and the top end has one or more stay attachment points for at least one stay. The at least one stay has a mast securing end and a craft securing end. The at least one stay and the elongated body of the mast member define at least one cone of rotation when secured to the craft and mast member. At least one of the cones of rotation is a minimal cone of rotation. The fairing member and flap element, from the axis of rotation of the fairing member to the back edge of the flap element, have a combined length less than the at least one stay of the minimum cone of rotation. That is, the fairing member and the flap element are constructed and arranged to rotate a full 360 degrees around the mast.

One embodiment features a fairing forward face and fairing back edge which define a chord length and the flap forward edge and flap back edge define a flap cord length. The fairing chord length and flap chord length define a combined fairing flap chord length. And, the combined fairing flap chord length is relatively constant about the length of the flap element. The length of the flap along one of the first flap forward edge or the second flap forward edge, and the combined fairing flap chord length define a ratio of between 5:1 and 60:1. And, in a further embodiment the ratio of the flap length and fairing flap chord distance is between 8:1 and 45:1. And, in a further embodiment the flap length and combined fairing flap chord ratio is between 9:1 and 35:1. That is, the fairing member and flap element define a narrow tall rectangle.

The flap chord length and the fairing chord length define a flap fairing chord ratio of between 1:0.01 and 1:0.20. That is, the flap element is a narrow aerodynamic surface along the wider fairing member.

One embodiment features a fairing member having an exterior shell selected from the group of materials consisting of plastic, aluminum, steel, fiber glass, and carbon fiber. Embodiments also feature a fairing member having a core which core is comprised of a material selected from the group consisting of expanded plastic foam, balsa wood and plastic honeycomb. Preferably, the core has an axial hollow for rotationally receiving the mast member, and, preferably the axial hollow has one or more bearing means for reducing friction between the fairing member and the mast member.

One embodiment features a flap element having a unitary construction of a material selected from the group consisting of plastic, aluminum, steel, fiber glass, and carbon fiber. Other embodiments feature a flap element having a wedge shape with a flat or rounded back surface spanning the first flap surface and second flap surface. The flap element can also be embedded into the structure of the fairing member. The flap element of the present invention can be used with or supplemented with other flaps and aerodynamic surfaces of the type depicted in U.S. patent application Ser. No. 13/606,259 filed Sep. 7, 2012, entitled aerodynamic Lift Device and Methods of Using the Same, the entire subject matter of which is incorporated by reference herein.

Embodiments of the present invention feature a fairing member and flap element and further comprising a mast member. Embodiment may also comprise a craft to which such mast member is mounted. The fairing member and flap element allow for the fitting of a head sail to at least one head stay to the mast member to which such are mounted.

A further embodiment of the present invention is directed to a method of powering a craft by aerodynamic forces. The method comprises the steps of providing a fairing member constructed and arranged for rotational attachment to a mast member, substantially encasing the elongated body of the mast member, and having a fairing base end and a fairing top end corresponding to the mast member. The fairing has a first fairing surface and a second fairing surface defining a symmetrical aerofoil cross-sectional shape with a projecting rounded forward face, an extending tapered back with a fairing back edge. The device further comprises one or more flap elements, wherein each flap element has a first flap surface and a second flap surface. The first flap surface is associated with the first fairing surface and the second flap surface is associated with the second fairing surface. Each flap surface has a forward edge towards the mast and a back edge distal to the mast and mechanically linked such that at least one of the first flap surface and second flap surface is projecting out from the first fairing surface and second fairing surface. Each flap element constructed and arranged to assume at least a first position and a second position. In the first position one of the first flap surface and second flap surface is aligned with the associated first fairing surface and the second fairing surface to define an aerofoil contour providing aerodynamic lift and the other flap surface is set at an angle of 60 to 120 degrees with respect to the corresponding fairing surface. And, in the second position, the first flap surface and second flap surface are projecting away from the respective fairing first surface and second fairing surface substantially equal angles such that no aerodynamic lift is made. The flap element is moveable to assume one or more positions relative to the fairing member to increase aerodynamic lift or to assume a position in which the flap element provides no aerodynamic lift. The method further comprises placing the device on the mast of a craft and moving the fairing member to a power position with the flap element in a first position to power the movement of the craft and allowing the fairing member assume a non-power position with the flap element in the second position to decrease the movement of the craft.

These and other features and advantages will be apparent to those skilled in the art upon viewing the drawings which are described in brief below and upon reading the detailed description that follows.

DETAILED DESCRIPTION OF THE INVENTION

Embodiments of the present invention will be described in detail as a device having rigid aerodynamic lift surfaces that can be controlled through all wind directions, and comprising, or used in conjunction with, a mast and a sailing vessel, such as a single hulled or multi-hulled boat. Those skilled in the art will recognize that the device may be used on land craft or ice boats as well. The depictions of the device used on watercraft feature larger vessels with the understanding that smaller vessels and crafts, including simple board-like craft can readily be used with embodiments of the present invention. These described embodiments exemplify the best mode of the invention and the manner of making and using such invention. However, embodiments of the present invention are subject to modification and alteration and the best mode contemplated may change over time.

Figure 1:
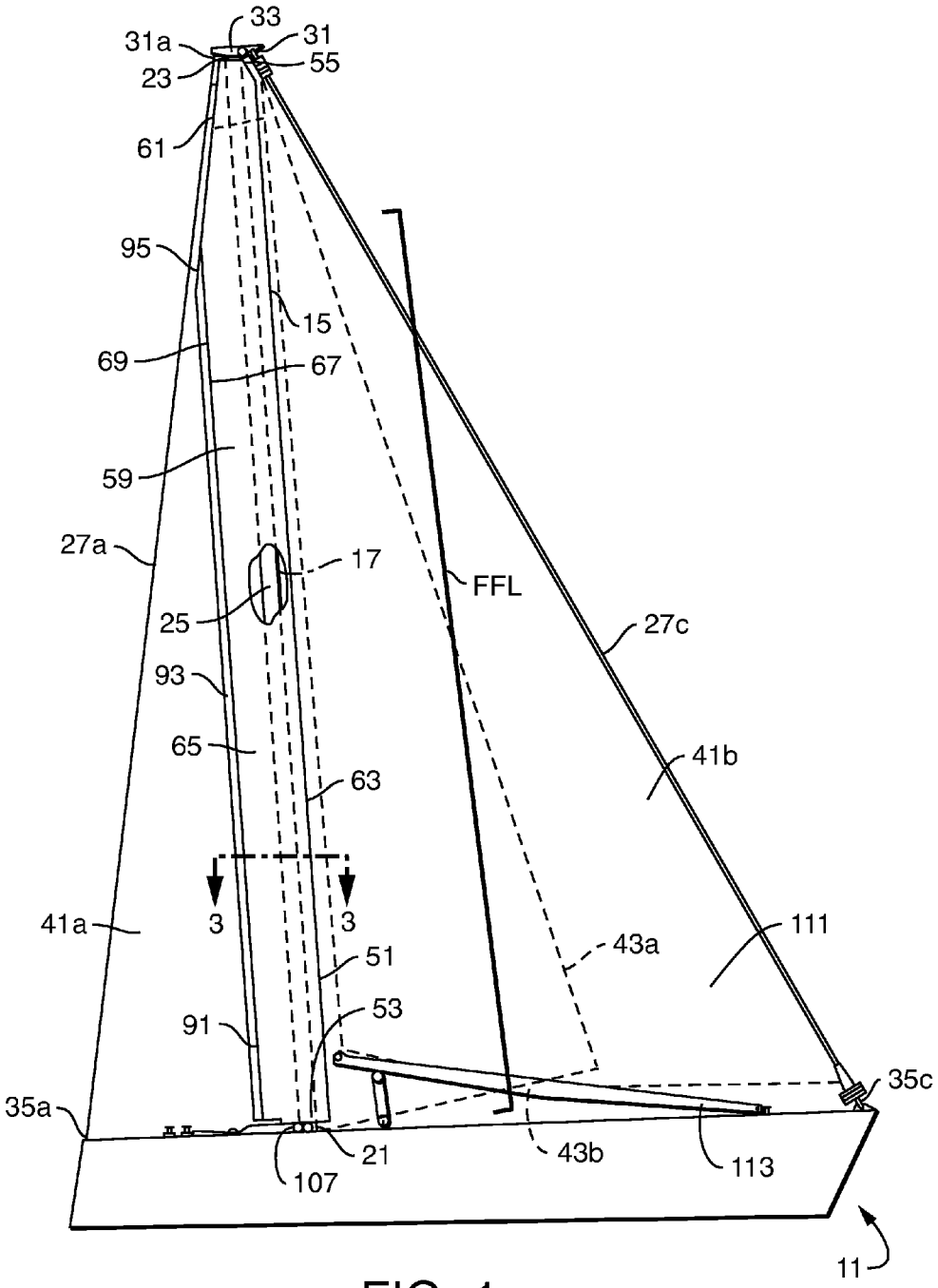
FIG. 1 depicts side view of a vessel embodying features of the present invention.

Turning now to FIG. 1, a vessel, generally designated by the numeral 11, is depicted having a device 15, embodying features of the present invention for powering a vessel 11 by aerodynamic forces. The device 15 is depicted in partial cutaway, to reveal a mast member 17.

Figure 2:
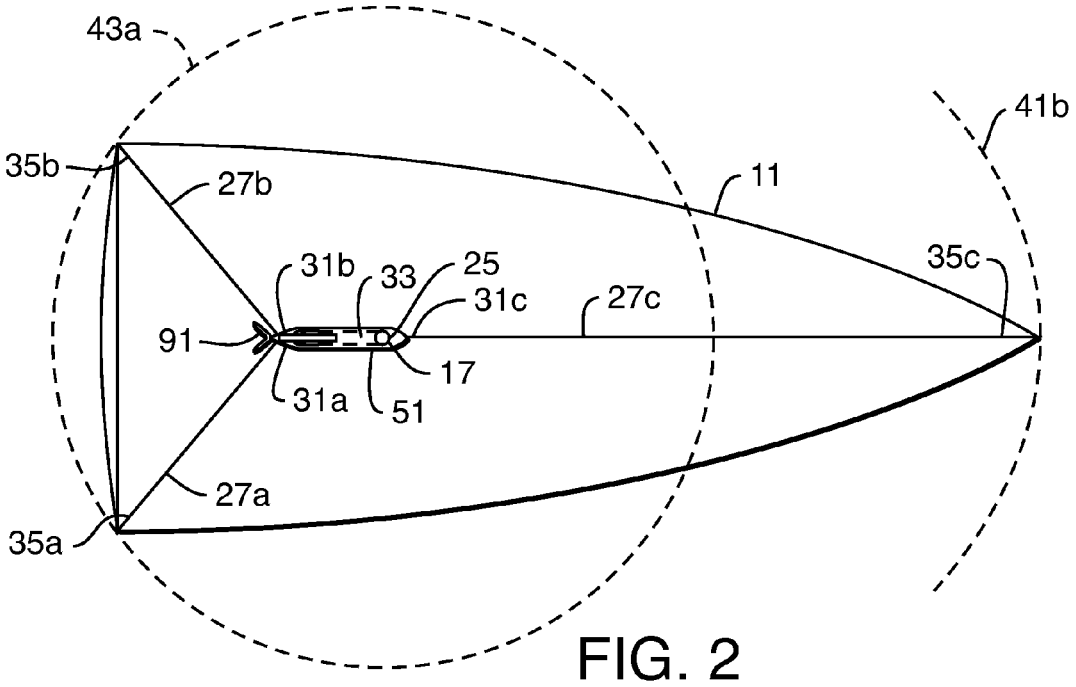
FIG. 2 depicts a top view of a vessel embodying features of the present invention.
Figure 3:
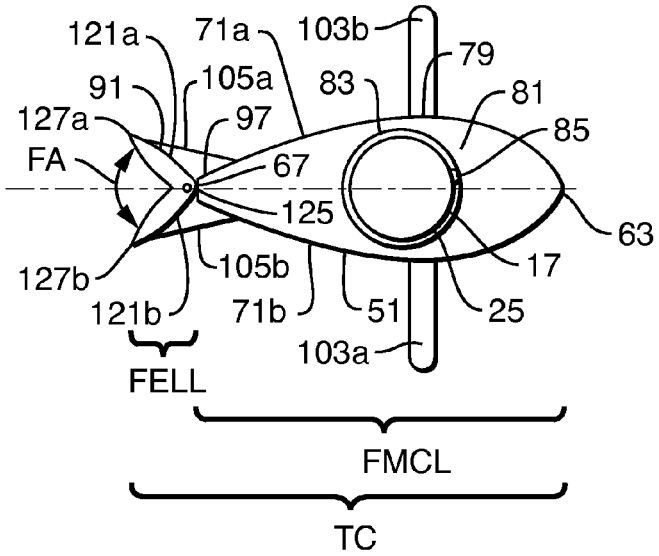
FIG. 3 depicts a top cross sectional view of a device embodying features of the present invention; and, FIGS. 4A-4D depict a top view of a device embodying features of the present invention at different point of wind.

The mast member 17 has a base end 21, a top end 23 and an elongated body 25. As depicted in FIGS. 2 and 3, elongated member 25 is cylindrical in shape with a substantially round, circular cross-section, although other cross-sectional shapes may be used. The base end 21 is fixed to a base of a vessel 11. A typical mast member for a twenty-five foot mono-hull vessel is about twenty five to thirty feet. Multihull vessels typically will have longer mast members for their respective hull length. As best seen in FIGS. 1 and 2, the top end 23 has a masthead 33 with one or more stay attachment points of which three are shown, designated 27*a* and 27*b* for stays directed to the stern of the vessel 11 and 27*c* for a single stay directed to the bow or forward part of the vessel 11.

As seen in FIG. 2, each stay 27*a*, 27*b* and 27*c* has a mast securing end 31*a*, 31*b* and 31*c* fixed to the mast member 17 or, as depicted to a mast head 33 fixed to the top end 23 of mast member 17. And, each stay 27*a*, 27*b* and 27*c* has a craft securing end 35*a*, 35 *b* and 35*c* fixed to the craft 11. The stays 27*a*, 27*b* and 27*c* are positioned and constructed to provide the mast with support. Typically, stays 27*a*, 27*b* and 27*c* are stainless steel cables, however, other materials such as carbon fibers, plastics and metals may be used as cables or solid supports may be used. Loads placed on the mast member 17 are transferred to the stays 27*a*, 27*b* and 27*c* and to the craft 11 to provide a robust structure capable of operating in extreme wind conditions.

Each stay 27*a*, 27*b* and 27*c* and the elongated body 25 define at least one cone of rotation 41*a* and 41*b*, if rotated in space. That is, a triangle occupying the space between the elongated member and a stay 27*a*, 27*b*, or 27 will form a cone shape when rotated about the center of the elongated member 25. Stays 27*a* and 27*b* share a common cone of rotation 41*a* because stays 27*a* and 27*b* are fixed to a common point at mast head 33 and an equal distance from the mast base 21. Referring now to FIG. 1, the cone of rotation 41*a* for the two back stays 27*a* and 27*b* is depicted in dotted lines 43*a* and 43*b* and the back stay 27*a*. This cone of rotation is the available space for rotation about the elongated member without interfering with the stay.

Referring to FIG. 2, forward stay 27*c* defines a larger cone of rotation 41*b* which is shown only in part due to the limitation of drawing space. Of the two cones of rotation 41*a* and 41*b*, cone of rotation 41*a* is smaller and is a minimal cone of rotation. As used herein, the minimum cone of rotation means the cone of rotation closest to the mast member 17 for a given point above the mast base 21.

Now returning to FIG. 1, the device 15 comprises a fairing member 51 constructed and arranged for rotational attachment to the mast member 17 and substantially encasing the elongated body 25. The fairing member 51 has a base end 53 and a top end 55 corresponding to the mast member 17. The fairing member 51 has a first section 59 and a second section 61. The first section 59 has a symmetrical aerofoil cross-sectional shape with a projecting rounded forward face 63 and an extending tapered back 65 ending in a fairing back edge 67. The first section 59 extends from the base end 53 upwards along the forward face 63 and tapered back 65 to a point inside the minimum cone of rotation 41*a*.

The second section 61 extends from such point inside the minimum cone of rotation 41*a* to the about the top end 55 and has a cross-sectional shape, a second forward face 67 and a second back 69. The second forward face 67 projects no further than and is substantially parallel to the minimum cone of rotation 41*a*. The second back 69 extends no further than and is substantially parallel to said minimum cone of rotation. The cross-sectional shape of second section 61 starting at the first section 59 and moving up, has the appearance of the first section 59 depicted in FIG. 3 and moves toward a more circular shape as the second forward face 67 and second back 69 moves closer to the center of the axis of rotation.

Thus, the fairing member 51 can be rotated a full rotation about the mast 17 to assume one or more positions relative to a wind to provide aerodynamic lift and one or more positions in which the fairing member provides no aerodynamic lift. The fairing can be released to feather in the wind, in the position in which no aerodynamic lift is generated, without interference from the stays.

As can best be seen in FIG. 1, the fairing member 51 has a fairing length defined by the top end 55 and base end 53. And, turning to FIG. 3, the forward face 63 and extending tapered back 65, having two fairing surfaces 71*a* and 71*b*, define a fairing chord distance denoted by bracket FC. The chord distance, returning now to FIG. 1, is approximately constant in the first section 59. The ratio of the fairing length and fairing chord distance is between 5:1 and 60:1. A further embodiment features a ratio of the fairing length and fairing chord distance between 8:1 and 45:1. Some embodiments of the present fairing feature a fairing length and fairing chord ratio of 9:1 and 35:1.

Returning now to FIG. 3, fairing member 51 has an exterior shell 79 selected from the group of materials consisting of plastic, aluminum, fiber glass, carbon fiber, plastic sheets (such as Mylar) or foil and fabric. Non-rigid materials, such as plastic sheets, foil fabric are preferably placed over a structural skeleton [not shown] or a core 81, as illustrated. Core 81 allows rigid exterior shell materials, such as plastic, aluminum, fiberglass and carbon fiber to be used in a manner minimizing thickness. As illustrated the core 81 supports an exterior shell 79 comprising fiber glass. Materials suitable for the core 81 are selected from the group consisting of expanded plastic foam, balsa wood and honeycomb materials.

Fairing member 51 has an axial hollow 83 for rotationally receiving the mast member 17. One or more bearing means are interposed between and affixed to or held in place by at least one of the fairing member 51 and mast member 17. Bearing means comprise such bearing articles such as low friction bushings 85 and rotatable bearing cylinders or balls with races and the like [not shown]. The bearing members reduce friction between the fairing member 51 and the mast member 17.

The fairing member 51 allows the mast member 17, supported and stabilized by one or more stays 27*a*, 27*b* and 27*c*, to withstand extreme wind conditions. The fairing member 51 does not bear significant compression forces associated with the structural mast member 17 and stays 27*a*, 27*b* and 27*c*. The device, fitted to a conventional mast equipped with stays, permits retrofitting of craft formerly fitted with sails.

The fairing member 51 has been depicted and described as a unitary structure. However, the fairing member 51 can be made in segments [not shown] which stack and fit to each other. The segments can be assembled for different mast heights or with different first sections 59 and second sections 61 to accommodate different vessels.

Turning now, again, to FIG. 1, device 15 further comprises a flap element 91. Although one flap element 91 is depicted in FIG. 1, those skilled in the art will recognize that the fairing member 51 may have several flap elements. Several flap elements may be desired, by way of example, without limitation, where the back edge 67 of the fairing member 51 is not a straight edge.

The flap element 91 has a first flap section 93 and a second flap section 95. The first flap section 93 extends from the base of the fairing member 51 to a point inside the minimum cone of rotation 41*a* along the back edge 67 of the fairing member 51. The second section 95 extends parallel to the cone of rotation 41*a* along the back edge 67 of fairing member 51 and is triangular in shape as it extends upward.

Turning now to FIG. 3, each flap element 91 has a first flap surface 121*a* and a second flap surface 121*b*. The first flap surface 121*a* is associated with the first fairing surface 71*a*; and, the second flap surface 121*b* is associated with the second fairing surface. That is, turning now to FIG. 4B, the first flap surface 121*a* is constructed and arranged to allow the flap surface 121*a* to assume a single aerodynamic surface with fairing surface 71*a*. Although not depicted in these series of Figures, in a similar manner, the second flap surface 121*b* forms an aerodynamic surface with fairing surface 71*b* when flap element 91 is moved with respect to fairing member 51. A single aerodynamic surface is a surface without significant interruption and without significant interference to allow air to smoothly move from the fairing surface to the flap surface.

Each flap surface 121*a* and 121*b* has a forward edge 125 towards the mast and a back edge 127*a* and 127*b* distal to the mast. The flap element 91 is rotatably mounted to the fairing member 51 at the forward edge 125 by suitable means such as hinges, cooperating pintles and gudgeons, flexing plastic or the like [not shown]. First flap surface 121*a* and second flap surface 121*b* are mechanically linked in the sense that, as depicted, flap element 91 is a unitary structure having a "V" shape and first flap surface 121*a* and second flap surface 121*b* share a common forward edge 125. However, those skilled in the art will recognize that each first flap surface 121*a* and each second flap surface 121*b* may have separate forward surfaces [not shown]. Flap element 51 may comprise separate and distinct flat planar surfaces [not shown] formed of supported membranes and fabrics, plastics or metal held by braces [not shown].

Figure 4A:
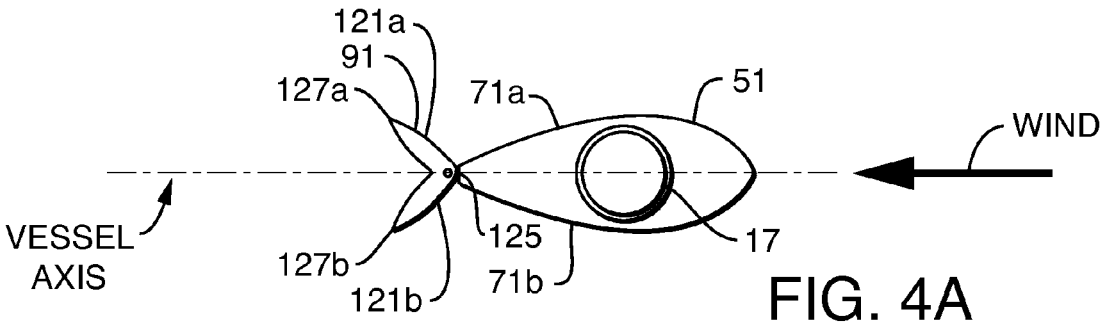
Figure 4B:
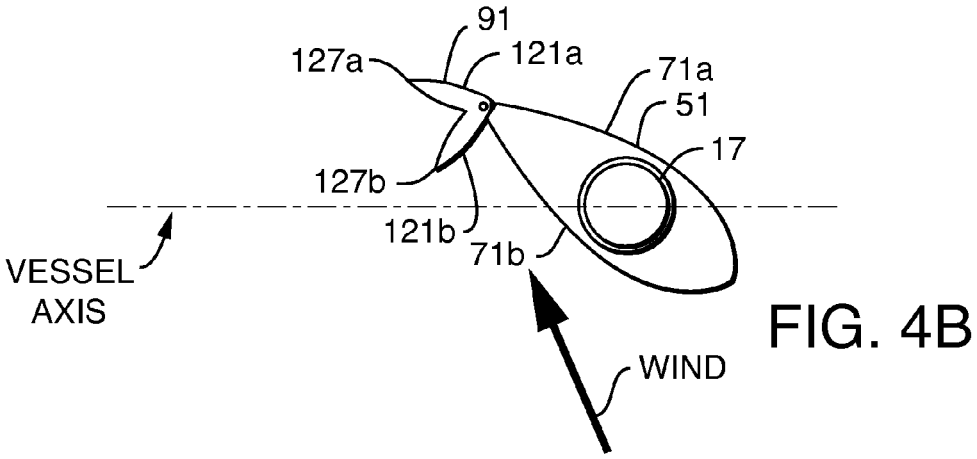
Figure 4C:
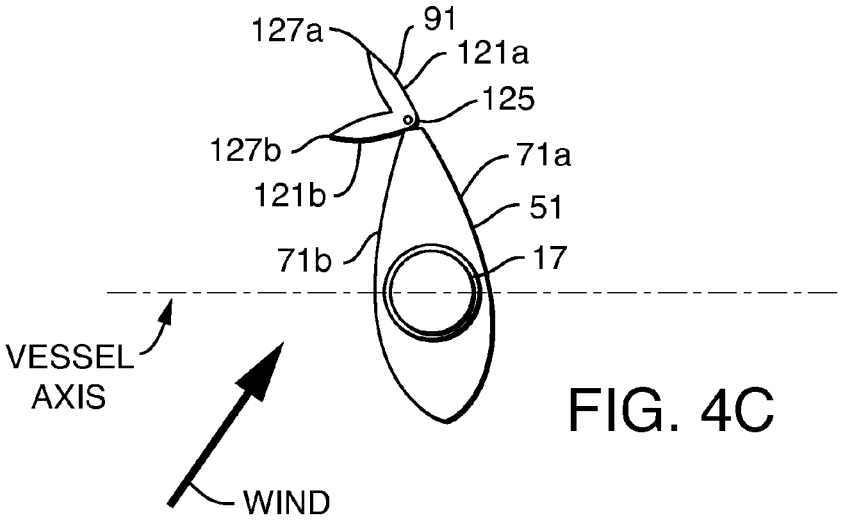

As best seen in FIGS. 4A-4D, and, in particular FIGS. 4B and 4C, each flap element 91 is capable of assuming a first position. Those skilled in the art will immediately recognize that the symmetrical fairing member 51 and flap element 91 can assume the reverse position, an opposite tack, to that shown in FIGS. 4B and 4C. In the first position, one of the first flap surface 121*a* and second flap surface 121*b* is aligned with the associated first fairing surface 71*a* and the second fairing surface 71*b* to define an aerofoil contour providing aerodynamic lift. As depicted, first flap surface 121*a*, on the low pressure side of the aerofoil, presents a relatively smooth aerofoil contour with first fairing surface 71*a*. And, the other flap surface, second flap surface 121*b*, on the high pressure side of the aerofoil, is set at an angle of 60 to 120 degrees with respect to the corresponding second fairing surface 71*b*. The second flap surface 121*b* creates a small amount of resistance or turbulence to wind in this position but the second flap surface increases the effective camber of the combined fairing and flap and increases the "lift" or driving forces from the wind. The flap element 91 is moveable to assume one or more positions relative to the fairing member 51 and the fairing member is able to rotate about the mast to increase or decrease aerodynamic lift.

Figure 4D:
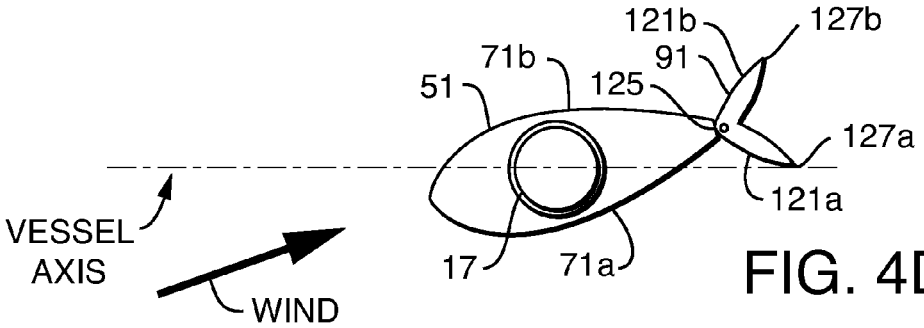

Now turning to FIG. 4A, the first flap surface 121*a* and second flap surface 121*b* are mechanically linked and project out from the first fairing surface 71*a* and second fairing surface 71*b* respectfully. In this second position, the flap element 51 does not present to the wind, aerodynamic surfaces on either side of fairing member 51. Air flow is interrupted on the first fairing surface 71*a* and on the second fairing surface 71*b* by the flap element 91. In this position the flap element 91 acts as a centering force directing the fairing member into the wind substantially without oscillation due to the resistance to movement exerted by the first flap surface 121*a* and second flap surface 121*b*. In the second position, the first flap surface 121*a* and second flap surface 121*b* project away from respective fairing first surface 71*a* and second fairing surface 71*b* substantially equal angles such that no aerodynamic lift is made. The chord ratio of the flap element to the fairing member is preferably small such that the flap element 91 creates little aerodynamic resistance to wind beyond what is necessary for the centering function. FIG. 4D represents the device 15 with the flap element 91 in a second position compelling the fairing member 51 to assume a non-power position with respect to the wind.

As illustrated in FIGS. 1 and 3 the device features a fairing member 51 and flap element 91 having a fairing flap length (FFL). The forward fairing face 63 and flap back edge 127*a* with respect to the first flap surface 121*a* and 127*b* with respect to the second flap surface 121*b* which define a fairing flap chord distance denoted by bracket TC. The total fairing flap chord length is approximately constant in the first flap section, the ratio of said fairing length and fairing flap chord distance is between 5:1 and 60:1. And, in a further embodiment the ratio of said fairing length and fairing flap chord distance is between 8:1 and 45:1. Some embodiments of the present fairing feature a fairing length and fairing flap chord ratio of 9:1 and 35:1. The flap element 91, defined by flap surface 121*a* or flap surface 121*b*, has a flap chord length (FECL) and the fairing member 51 has a chord length (FMCL) and the ratio of FECL to FMCL is approximately 1:0.01 to 1:0.20.

The first flap surface 121*a* and second flap surface 121*b* define an angle FA which is approximately 25 to 100 degrees measured from the closed angle.

The flap element 91 is made in a manner similar to the fairing member 51 with a core and shell or is a solid piece of light weight material such as plastic, fiber glass, light weight metals, or carbon fiber.

The device 15 has fairing control means for compelling the fairing member 51 to assume a position with respect to the wind. The fairing control means comprises one or more arms projecting from the fairing member which are pushed or pulled by lines or hydraulics or fitted with gears or wheels for turning the fairing member 51. FIG. 3 depicts two control arms 103*a* and 103*b* projecting from the sides of the fairing member 51. The control arms are preferably fitted with lines which would be powered by winches. The control arms 103*a* and 103*b* are located about the base 53 of the fairing member 51.

The device 15 has flap control means for compelling the flap to assume a position with respect to the wind. Flap control means comprise one or more flap control arms projecting from at least one of the fairing member 51 or flap 91 which are pushed or pulled by lines or hydraulics or fitted with gears of wheels for turning the flap element 91 with respect to the fairing member 51. As best seen in FIG. 3, as illustrated, flap control means in the form of flap control lines 105*a* and 105*b* which travel through line channels [not shown] running down the fairing member 51 to the base 53.

The fairing member 51 rests on base bearings 107 allowing the fairing member 51 to rotate about the mast member 17. The fairing member 51 does not need to carry the weight and structural load of the mast member 17 and stays 27*a*, 27*b* and 27*c* and can assume positions influenced by the wind when control means are not determining the position. That is, the fairing member 51 can be readily feathered, in a non-powering position.

The device 15 may have an integrated mast member 17 or can readily be fitted to existing masts. Similarly, the device 15 may be integrated into a craft such as craft 11. As illustrated craft 11 features at least one head stay 27*c* that carries a sail 111. The sail 111 is fitted to a boom 113. The boom 113 extends from about the head stay 27*c* to a point towards the mast member 17 allowing the fairing member 51 and flap element 91 to freely rotate.

The method of the present invention for powering a craft 11 will now be described with respect to the operation of the device 15 with respect to FIGS. 1 and 4*a*, 4*b*, 4*c* and 4*d*. The craft 11 has a mast member 17 having a base end 21, a top end 23 and an elongated body 25. The base end 21 is attached to the craft 11 and the top end 23 has a mast head 33 with stay attachment points. Each stay 27*a*, 27*b* and 27*c* is secured to the mast member 17 and the craft 11, defining at least one cone of rotation and at least one of said cone of rotation being a minimal cone of rotation. The method comprises the step of providing a device 15 having a fairing member 51 and a flap element 91 constructed and arranged for rotational attachment to the mast member 17 with the fairing member 51 substantially encasing the elongated body 25. The fairing member 51 has a base end 53 and a top end 55 corresponding to the mast member 17 and has a first fairing section 59 and a second fairing section 61. The first fairing section 59 extends from the base towards a point inside the minimum cone of rotation 41*a*. The first fairing section 59 has a symmetrical aerofoil cross-sectional shape with a projecting rounded forward face 63 and an extending tapered back 65. The second fairing section 61 extends from the first fairing section 59 to the about the top end 55 and has a cross-sectional shape a second forward face 67 and a second back 69. The second forward face 67 projects no further than and substantially parallel to the minimum cone of rotation 41*a*, and the second back 69 extends no further than and substantially parallel to said minimum cone of rotation 41*a*.

The flap element 91 has a first flap section 93 and a second flap section 95. The first flap section 93 extends from the base of the fairing member 51 to a point inside the minimum cone of rotation 41*a* along the back edge 67 of the fairing member 51. The second section 95 extends parallel to the cone of rotation 41*a* along the back edge 67 of fairing member 51 and is triangular in shape as it extends upward.

Each flap element 91 has a first flap surface 121*a* and a second flap surface 121*b* and is capable of assuming a first position and a second position. The first flap surface 121*a* and second flap surface 121*b* are mechanically linked and project out from the first fairing surface 71*a* and second fairing surface 71*b* respectfully in a second position as depicted in FIGS. 4A and 4D. Each flap element 91 is capable of assuming a first position as best seen in FIGS. 4B and 4C. In the first position, one of the first flap surface 121*a* and second flap surface 121*b* is aligned with the associated first fairing surface 71*a* and said second fairing surface 71*b* to define a aerofoil contour providing aerodynamic lift. As depicted, first flap surface 121*a*, on the low pressure side of the aerofoil, presents a relatively smooth aerofoil contour with first fairing surface 71*a*. And, the other flap surface, second flap surface 121*b*, on the high pressure side of the aerofoil, is set at an angle of 60 to 120 degrees with respect to the corresponding second fairing surface 71*b*. The flap element 91 is moveable to assume one or more positions relative to the fairing member 51 and the fairing member is able to rotate about the mast to increase or decrease aerodynamic lift.

The method further comprises the step of moving the fairing member 51 to a power position with the flap member 91 in the first position and moving and/or allowing the fairing member 51 to assume the non-power position with flap element 91 in the second position.

Thus, we have described the device and methods of making and using the device. The device has rigid aerodynamic lift surfaces that can be controlled through all wind directions, and is structurally robust for carrying one or more sails. Embodiments of the present invention described and illustrated herein are the best mode presently contemplated for making and using the invention and as such are capable of modification and alteration. Therefore, the present invention should not be limited to the precise details set forth herein but should encompass such subject matter of the claims that follow and their equivalents.

The invention claimed is:

1. A device for powering a craft by aerodynamic forces, said craft having a mast member having a base end, a top end and an elongated body, said base end constructed and arranged for attachment to a base of said craft, said top end for projecting away from said craft, said device comprising:

a fairing member constructed and arranged for rotational attachment to said mast member and substantially encasing the elongated body, said fairing member having a base end and a top end corresponding to said mast member, said fairing member having a first fairing surface and a second fairing surface defining a symmetrical aerofoil cross-sectional shape with a projecting rounded forward face, an extending tapered back with a fairing back edge, one or more flap elements, each flap element having a first flap surface and a second flap surface, said first flap surface associated with said first fairing surface and said second flap surface associated with said second fairing surface, each flap surface having a forward edge towards said mast and a back edge distal to said mast and mechanically linked such that at least one of said first flap surface and second flap surface is projecting out from said first fairing surface and second fairing surface, each flap element capable of assuming at least a first position and a second position, in said first position one of said first flap surface and second flap surface is aligned with said associated first fairing surface and said second fairing surface to define a aerofoil contour providing aerodynamic lift and one of said first flap surface and one of said first flap surface and second flap surface is set at an angle of 60 to 120 degrees with respect to the associated fairing surface, and in said second position said first flap surface projecting away from said first fairing surface and said second flap surface projecting away from said second fairing surface such that no aerodynamic lift is made; said one or more flap elements moveable to assume said first position to increase aerodynamic lift or moveable to said second position to provide no aerodynamic lift.

2. The device of claim 1 wherein one or more flap elements have said first flap surface and second flap surface joined about the forward edge to form a forward edge angle, and said one or more flap elements rotatably mounted to said fairing member at said first flap forward edge and said second flap forward edge.

3. The device of claim 2 wherein said forward edge angle is 25 to 120 degrees.

4. The device of claim 2 wherein said first flap forward edge and second flap forward edge are rotatably mounted to said fairing member at said fairing back edge.

5. The device of claim 1 wherein said fairing member is rotatable about said mast to assume a power position and a non-power position, wherein in said power position said fairing member and said one or more flap elements define at least one aerofoil contour about a first fairing surface and second fairing surface providing aerodynamic lift and wherein in said non power position said fairing member has said projected rounded face directed into a wind and said one or more flap elements has said first flap surface and second flap surface projecting away from respective first fairing surface and second fairing surface such that no aerodynamic lift is made.

6. The device of claim 5 further comprising fairing control means for compelling said fairing member to assume a power position and said one or more flap elements to assume a first position.

7. The device of claim 6 wherein said fairing control means allow said fairing member to assume a non-power position in which the one or more flap elements create substantially equal resistance to the fairing member to direct said projecting rounded forward face to the direction of wind.

8. The device of claim 1 wherein each flap element has a flap vertical length and said fairing forward face and fairing back edge define a fairing chord length and said forward edge and flap back edge defines a flap cord length, said fairing chord length to flap chord length define a ratio of 1:0.01 to 1:0.20 about the flap vertical length.

9. The device of claim 1 wherein said fairing member has a fairing vertical length said fairing member and one or more flap elements define a total chord length and said total chord length is constant about the fairing vertical length.

10. The device of claim 1 wherein said fairing member has an exterior shell selected from the group of materials consisting of plastic, aluminum, fiber glass, and carbon fiber.

11. The device of claim 1 wherein said fairing member has a core.

12. The device of claim 11 wherein said core is comprised of a material selected from the group consisting of expanded plastic foam, balsa wood and plastic honeycomb.

13. The device of claim 11 wherein said core has an axial hollow for rotationally receiving said mast member.

14. The device of claim 11 further comprising one or more bearing means for reducing friction between said fairing member and said mast member.

15. The device of claim 1 further comprising a mast member.

16. The device of claim 15 further comprising a craft.

17. The device of claim 16 wherein said mast member is secured to said craft by at least one head stay.

18. The device of claim 17 wherein said at least one head stay carries a sail.

19. A method for powering a craft by aerodynamic forces, said craft having a mast member having a base end, a top end and an elongated body, said base end constructed and arranged for attachment to a base of said craft, said top end for projecting away from said craft, said method comprising the steps of:

a. providing a device having a fairing member and one or more flap elements;

i. said fairing member constructed and arranged for rotational attachment to said mast member and substantially encasing the elongated body, said fairing member having a base end and a top end corresponding to said mast member, said fairing member having a first fairing surface and a second fairing surface defining a symmetrical aerofoil cross-sectional shape with a projecting rounded forward face, an extending tapered back with a fairing back edge, ii. each flap element having a first flap surface and a second flap surface, said first flap surface associated with said first fairing surface and said second flap surface associated with said second fairing surface, each flap surface having a forward edge towards said mast and a back edge distal to said mast and mechanically linked such that at least one of said first flap surface and second flap surface is projecting out from said first fairing surface and second fairing surface, each flap element capable of assuming a first position and a second position, in said first position one of said first flap surface and second flap surface is aligned with said associated first fairing surface and said second fairing surface to define a aerofoil contour providing aerodynamic lift and one of said first flap surface and second flap surface is set at an angle of 60 to 120 degrees with respect to the associated fairing surface, and in said second position said first flap surface projecting away from said first fairing surface and said second flap surface projecting away from said second fairing surface such that no aerodynamic lift is made; said one or more flap elements moveable to a first position relative to increase aerodynamic lift or moveable to said second position to provide no aerodynamic lift;

b. moving said fairing element position selected from the group of a power position, with the flap elements in said first position, and a non-power position, with said one or more flap element in said second position.

20. The method of claim 19 wherein said fairing member is rotatable about said mast to assume a power position and a non-power position, wherein in said power position said fairing member and said one or more flap elements define at least one aerofoil contour about a first fairing surface and second fairing surface providing aerodynamic lift and wherein in said non power position said fairing member has said projected rounded face directed into a wind and said one or more flap elements has said first flap surface projecting away from said first fairing surface and second said flap surface projecting away from said second fairing surface such that no aerodynamic lift is made.

21. The method of claim 20 wherein said device further comprises fairing control means for compelling said fairing member to assume a power position and said one or more flap elements to assume a first position.

22. The method of claim 21 wherein said fairing control means allow said fairing member to assume a non-power position in which said one or more flap elements create resistance to direct said projected rounded forward face to the direction of wind.

* * * * *